US006170168B1

(12) United States Patent
Fosbøl et al.

(10) Patent No.: US 6,170,168 B1
(45) Date of Patent: Jan. 9, 2001

(54) CIRCULAR DRYING ELEMENT AND DRYING PLANT WITH SUCH A DRYING ELEMENT

(75) Inventors: Peder Fosbøl, Lyngby; Finn Jørgensen, København, both of (DK)

(73) Assignee: Atlas-Stord Denmark A/S, Ballerup (DK)

( * ) Notice: Under 35 U.S.C. 154(b), the term of this patent shall be extended for 0 days.

(21) Appl. No.: 09/269,266

(22) PCT Filed: Oct. 6, 1997

(86) PCT No.: PCT/DK97/00428

§ 371 Date: Mar. 25, 1999

§ 102(e) Date: Mar. 25, 1999

(87) PCT Pub. No.: WO98/15791

PCT Pub. Date: Apr. 16, 1998

(30) Foreign Application Priority Data

Oct. 8, 1996 (DK) ..... 1105-96
May 15, 1997 (DK) ..... 0557-97

(51) Int. Cl.[7] ..... F26B 11/12
(52) U.S. Cl. ..... 34/184; 34/179; 34/183
(58) Field of Search ..... 34/179, 181, 182, 34/183, 184

(56) References Cited

U.S. PATENT DOCUMENTS 749,828 * 1/1904 Wertenbruch ..... 34/182
1,488,216 * 3/1924 Overton ..... 34/181
3,777,810 * 12/1973 Phillips ..... 165/92
3,800,865 * 4/1974 Onarheim et al. ..... 165/92
3,808,701 5/1974 Bachmann ..... 34/179
3,923,097 * 12/1975 Hovad ..... 165/92
4,074,751 * 2/1978 Ducasse ..... 165/92
4,621,684 11/1986 Delahunty ..... 165/92
4,711,041 * 12/1987 Ullum ..... 34/179
4,982,514 * 1/1991 Ullum ..... 34/183

* cited by examiner

*Primary Examiner*—Denise L. Ferensic
*Assistant Examiner*—Michelle A Mattera
(74) *Attorney, Agent, or Firm*—Antonelli, Terry, Stout & Kraus, LLP

(57) ABSTRACT

Annular drying element (15) for mounting on a rotor axle in a drying plant for indirect heating or cooling of moist, comminuted, biological material such as fishmeal, offal from slaughterhouses, mash from breweries and similar materials of animal, vegetable or chemical origin. The drying element is configured with a number of through-going openings (25) extending from the one side of the element to the other. The drying element can be made of two identical, annular plate elements (16) with holes (25), in that tubular stays are welded between oppositely-lying holes. Through the openings (25), elongated elements can be inserted which increase the stirring in the product mass which is to be heat-treated.

23 Claims, 7 Drawing Sheets

CIRCULAR DRYING ELEMENT AND DRYING PLANT WITH SUCH A DRYING ELEMENT

BACKGROUND OF THE INVENTION

1. Field of the Invention

The invention concerns an annular drying element. Such drying elements, which constitute a heat exchanger, are used in drying plants for indirect heating or cooling of moist, comminuted materials, e.g. biological materials such as fishmeal, comminuted offal from slaughterhouses, mash from breweries and similar materials of animal, vegetable or chemical origin.

The drying plant comprises a stationary housing and a rotatable rotor with a number of annular drying elements disposed at intervals. The rotor has means for supplying the medium for heating or cooling. For heating, steam is often used, and thus the rotor is also provided with means for the removal of a condensate thereof.

2. Description of the Prior Art

Plants of this type are known, e.g. from U.S. Pat. No. 3,923,097 (Atlas, DK) and U.S. Pat. No. 4,982,514 (Atlas, DK), and have been in use for many years. The plants have an opening in the one end for the supply of raw material, and an opening in the opposite end for the removal of the material after it has been treated. The transport through the plant is effected mainly as a consequence of the continuous filling with new raw material and the continuous removal of the treated material, but the transport can be increased or reduced by using vanes, lifting elements or the like, e.g. disposed directly on the drying elements. The transport through the plant is possible because the annular drying elements do not extend completely out to the stationary housing. Rotating driers with stirrers or transport vanes are known, e.g. from U.S. Pat. No. 3,800,865 (Stord Bartz, NO) or U.S. Pat. No. 3,777,810 (The Strong Scott Company, US).

In older constructions, cf. e.g. GB Patent No. 952,099 (A/S Myrens Verksted, NO), use has been made of a rotating drier with drying elements built up of tubes, e.g. annular or helical tube constructions, which can be configured so that the steam condensate is led towards a tapping-off point during the rotation. Furthermore, from U.S. Pat. No. 4,074,751 (Unice Machine Company, US) there are known rotating heat exchangers of tubes arranged for the heating or cooling of a fluid mass, e.g. sugar massecuites.

In the latter two constructions, the product to be heat treated or dried is fed forward in the plant by passing through the openings in the drying elements which arise between the tubes. This can have advantages with regard to the stirring and the transport of the product, but has great disadvantages with regard to the avoidance of the product settling on the drying element. Moreover, drying elements of this kind do not have as large a heating surface as the plate-formed drying elements mentioned earlier.

SUMMARY OF THE INVENTION

The invention also concerns a drying plant. If a drying plant with drying elements as explained above is to be used for the heat treatment, drying or cooling of a relatively fluid product, e.g. a very greasy or oily product, e.g. the boiling of oil- or fat-containing offal from slaughter-houses, the stirring in the product mass can cause increased processing time. Therefore, the need can arise for an increase in the stirring of the product mass.

By configuring the annular drying elements according to the invention, it is achieved that all of the known advantages with plate-formed drying elements are retained, and at the same time the possibility is provided of obtaining a changed product-flow through the plant.

There are many advantages from the point of view of production technique with drying elements of plate-formed elements, and as a rule a greater heat-exchange surface is achieved than with drying elements configured as tube constructions.

Moreover, the drying element of the kind disclosed in the application has advantages in that it can be produced by the welding together of parts which are configured in such a way that the welding can be automated in a simple manner by using automatic welding machines or welding robots, which reduces the production costs.

The openings in the annular plate elements are preferably configured by the insertion of a tube piece in each opening, preferably so that the longitudinal axes of the tube pieces are parallel with the axis of the drying element. Good possibilities are hereby achieved of simplifying the production of the drying elements.

However, the annular drying element according to the invention is preferably configured in such a way that it is built up of two substantially identical plate elements and, preferably has tube pieces inserted as stays between the plate elements at their oppositely-lying openings. There is hereby achieved a great degree of simplification in the production of the drying elements, and at the same time herewith a very strong and rigid construction is achieved which can tolerate a high pressure, which makes it possible to use steam at a high temperature as the heating medium.

The tubular stays are preferably configured with a circular cross-sectional profile. Among other things, this makes it possible to use tubes of standard manufacture which can be cut off in the desired lengths.

The tubular stays are preferably distributed over the surface of the drying element, so that there is minimal deflection or deformation of the drying element when pressurized steam is used as the heating medium.

The length of the tubular stays can be at least the thickness of the element. If the tube length corresponds to the thickness of the element, there is the possibility of being able to use scraping elements in the drying plant which scrape the drying elements clean, which e.g. can be relevant at that end where the product is most moist, or in that zone where the product is the most sticky. However, the tubular stays can also be of a length which is greater than the thickness of the element, and the free ends of the tubes can be configured so that they constitute a carrier or a stirring element for the product to be dried.

For certain constructions, it can be an advantage to configure the drying element by making use of tubular stays with different clearances on the same drying element. The possibility is hereby achieved of variations regarding where there may be larger openings and where there may be smaller openings on the drying element.

Finally, the drying element according to the invention can be configured in circles concentric with an outer edge of the drying element which offers important advantages from the point of view of production technique.

By configuring the plant a number of annular drying elements an increased stirring in the product mass can be achieved without this giving rise to other substantial disadvantages. An increased stirring will result in a quicker treatment of the product mass, e.g. possibility of quicker heat treatment, which increases the capacity of the plant. The mounted axial elements serve as stirrers and, depending on their configuration, also as lifting elements, so that the product mass can be stirred thoroughly if there is a need for it.

How many axial elements are mounted and which form they shall have will depend on the current conditions and the actual product, e.g. the degree to which it is desired to increase the stirring, and to what degree the transport of the product can possibly be desired to be reduced, in that the elements fill out some of the through-going openings in the rotor's drying elements.

Depending on how the stirring is desired to be carried out, the elements can be configured to extend over all of the drying elements. In brief, the number and the length of the axial elements are contributory factors in determining where in the drier an increased stirring is desired, and how great the increased stirring shall be.

It can be an advantage if the elements are configured as a tube with clearance. When using tubes as elements, e.g. tubes with circular cross-sectional profile, in many respects a suitably increased stirring is achieved without any considerable increase in the weight of the rotor. An advantage here is also that use can be made of standard tubes as elements.

It will be obvious to those familiar with the art that the axial elements can be configured from rods or tubes with almost any cross-sectional profile. However, it will be normal practice to take into account the shape of the through-going openings in the drying elements and to use elements which substantially fill out these openings, which is why tubular elements with circular cross-sectional profile constitute a preferred embodiment.

The elements in the drier can thus have different or varying cross-sectional profiles along their length, so that there are areas which provide suitable engagement with the drying elements, and areas which function as stirrers and/or lifting elements as required.

The elements are preferably secured to only one drying element, e.g. by welding, and preferably at the one end of the elements. Mechanical stresses due to differences in temperature etc. are hereby avoided, in that the axial elements can expand/contract in the longitudinal direction without this giving rise to mechanical influences on the rotor's drying elements, in that they can be displaced in the openings in the axial direction where they are not welded fast.

The possibility is achieved of increased energy supply via the axial elements in accordance with the invention. A plant with a given volume can thus be given a greater capacity, e.g. a greater heat treatment capacity, in that a greater amount of energy can be supplied.

A practical way in which thermal energy can be supplied to the axial tube elements is with a manifold. Use can be made of the same heat medium as that used for the annular drying elements, e.g. steam, but the supply of energy to the axial elements can also be configured separately, so that a lower or a higher temperature can be used herein if this is required.

Through a cover, preferably a cover in the one end of the drying plant housing, axial elements according to the invention can be mounted or removed as required. This has great practical and economical advantages, e.g. if a drying plant has to be changed to be able to process another product, or to process the product in a way which is different to that for which it was originally intended.

BRIEF DESCRIPTION OF THE DRAWINGS

The invention will now be described in more detail with reference to the drawings, in that FIG. 1 shows the principle in a known drying plant with annular drying elements on a rotor axle.

DESCRIPTION OF THE PREFERRED EMBODIMENTS

Figure 1:
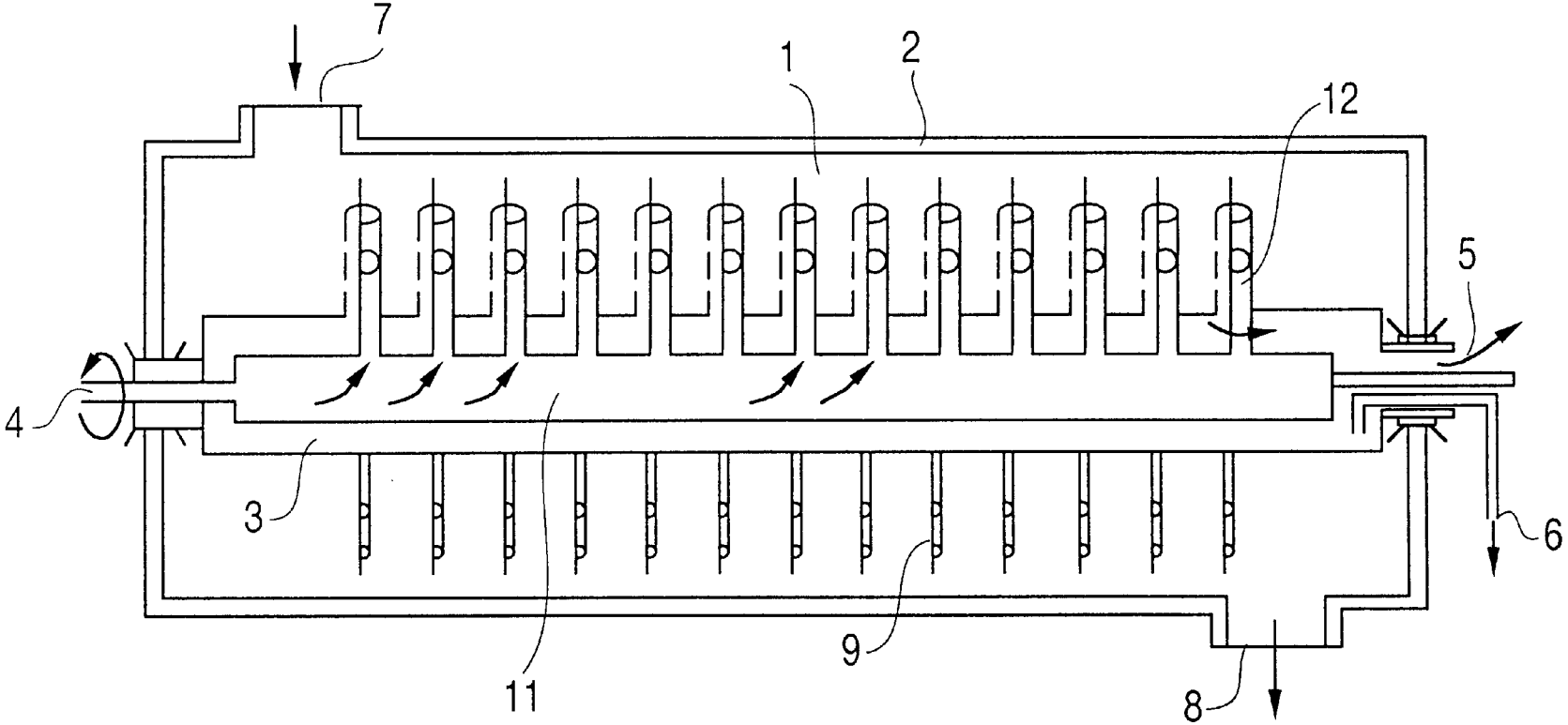
Figure 2:
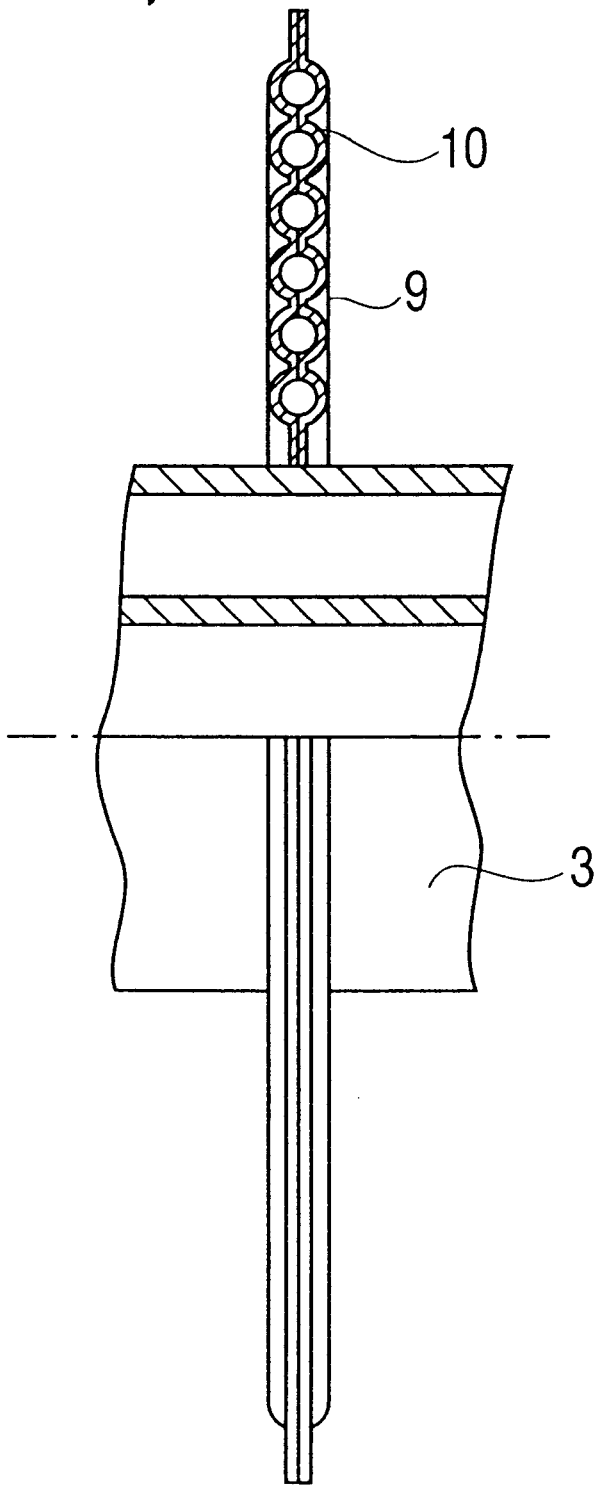
FIG. 2 (PRIOR ART)
FIG. 2 shows a section through a known annular drying element.

FIGS. 1 and 2 show the principle of the known technique, in that FIG. 1 shows a schematic longitudinal section in a drying plant comprising a stationary housing 2, possibly with heat jacket, an opening 7 for the introduction of the material to be dried, and an opening 8 for the discharge of the material after it has been processed. The material introduced is dried by means of a heated, rotating rotor 3 with circular, plane drying elements 9 disposed at intervals.

When the plant is continuously filled with new raw material, which is to be heated and dried, possibly boiled or sterilised, it will move towards the discharge opening while giving off moisture which is removed from the housing in a known manner.

The rotor 3 has a supply pipe 4 for the heating medium, e.g. steam, which via a central pipe 11 is fed to the drying elements 12. Return steam is led away via a discharge pipe 5, and condensate via the discharge pipe 6.

FIG. 2 shows part of the radial section of a drying element 9 and shows an example of how a known drying element can be arranged. The drying element consists of two annular plate elements welded together, in which there are formed channels 10 for the heating medium, e.g. steam.

The plant shown in FIGS. 1 and 2 explains the principle of a drying plant, and corresponds to that which is known from U.S. Pat. No. 4,982,514.

The present invention concerns a new configuration of the drying elements, which is explained in more detail with reference to FIGS. 3–7.

Figure 4:
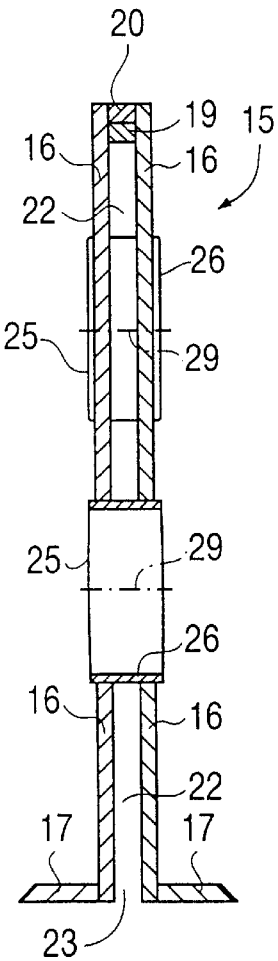
FIG. 4 shows a section in FIG. 3 seen in the direction IV—IV and shown on a larger scale.
Figure 3:
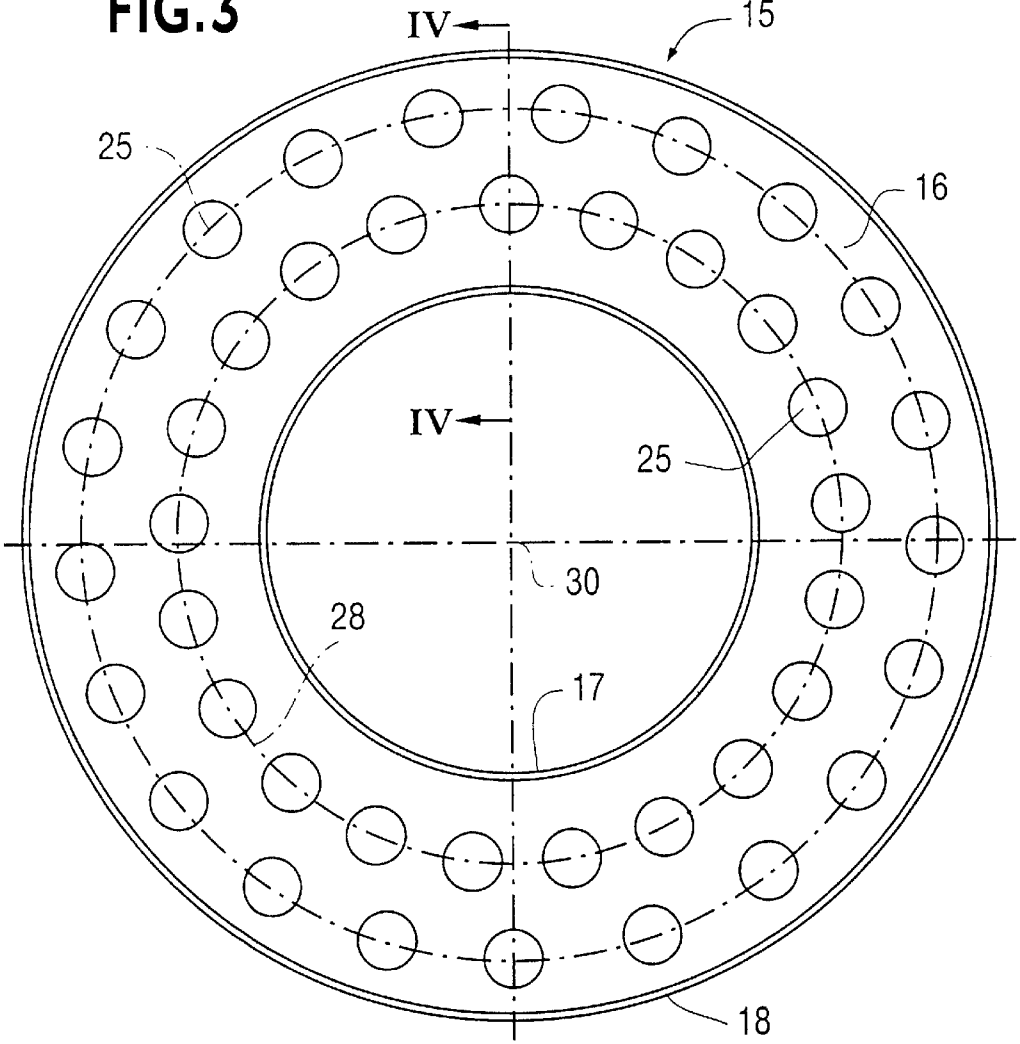
FIG. 3 shows a first embodiment of a drying element according to the invention.

In FIG. 3 is shown an embodiment according to the invention of a drying element 15 seen at right-angles to the surface, and in FIG. 4 is seen a radial section herein, for the sake of clarity shown on a larger scale. The drying element consists of two identical, plane, annular disks or plate elements 16 of steel plate. The annular disks or plate elements 16 are e.g. 2 m in diameter and have a number of holes 25, e.g. 42 holes as shown. The two plate elements 16 are coupled together, in that they are joined together along the outer edge 18 by means of an annular steel band 19 and an annular weld 20. At the inner edge, each of the plate elements 16 is provided with an annular foot-piece 17. The plate elements have a thickness in the order of 6–10 mm. In all of the holes 25 there is inserted and welded a tube piece 26 for both plate elements, so that the tube pieces 26 constitute stays between the plate elements. In the example shown, the stays are 4' tube pieces.

The tubular pieces 26 are welded solidly and in a pressure-tight manner to the two plate elements 16, so that between these there is formed a chamber 22 for the heating medium, e.g. steam under pressure at 10 baro, said chamber having an annular opening 23 for the supply of steam and the removal of return steam and condensate in a commonly-known manner. The foot-pieces 17 which, as shown in the drawing, extend out on each side of the plate element, are arranged to be welded directly together with adjacent elements and hereby constitute a pipe element which surrounds the rotor axle in a drying plant as described earlier.

In the example in FIGS. 3 and 4, the axes 29 of the tubular stays 26 are parallel with the axis 30 of the drying element, and the tubular stays are of such a length that they correspond substantially to the thickness of the element.

Figure 5:
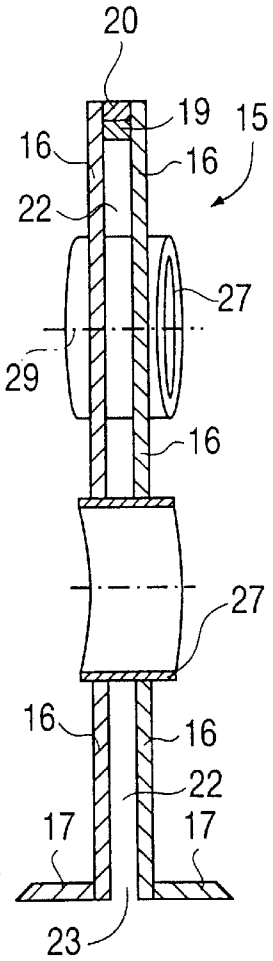
FIG. 5 shows a section corresponding to FIG. 4, but in a second embodiment.

In the example in FIG. 5, the tubular stays 27 are shown with a length which is greater than the thickness of the drying element 15 and thus extend out over the element's surface. Furthermore, it is possible for the tubular stays 27 to be cut off in a manner which is not parallel with the plane of the plate element 16, but at an angle which is oblique hereto, or possibly with a completely different shape, so that the protruding tubular stays constitute vane elements, carriers or stirring elements which have influence on the stirring of the material which is dried in the plant.

Between the two sides of each drying element 15 there is now direct connection through the tubular stays 26, 27 via the openings 25 herein, hereby making it possible for the material to be transported axially through the drying element.

For production reasons, the axes 29 of the tubular stays are parallel with the axis 30 of the drying element, but naturally there is nothing to prevent the tubular stays being disposed so that the axes are not parallel.

In the example in FIGS. 3–5, the tubular stays and herewith the openings 25 are disposed in two circles 28 which are concentric with the outer edge 18 of the drying element, and displaced from each other to provide a substantially even distribution of the tubular stays over the element, whereby it is achieved that the free plate area between the tubular stays does not become too great. This is of significance for how high a steam pressure can be applied to the element without any great deflections arising in the plate material between the tubular stays.

Figure 7:
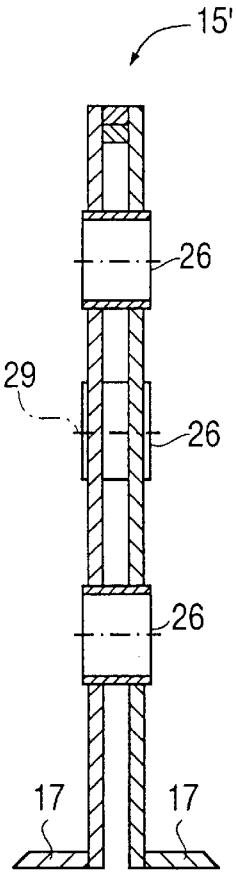
FIG. 7 shows a section in FIG. 6 seen in the direction VII—VII and shown on a larger scale.
Figure 6:
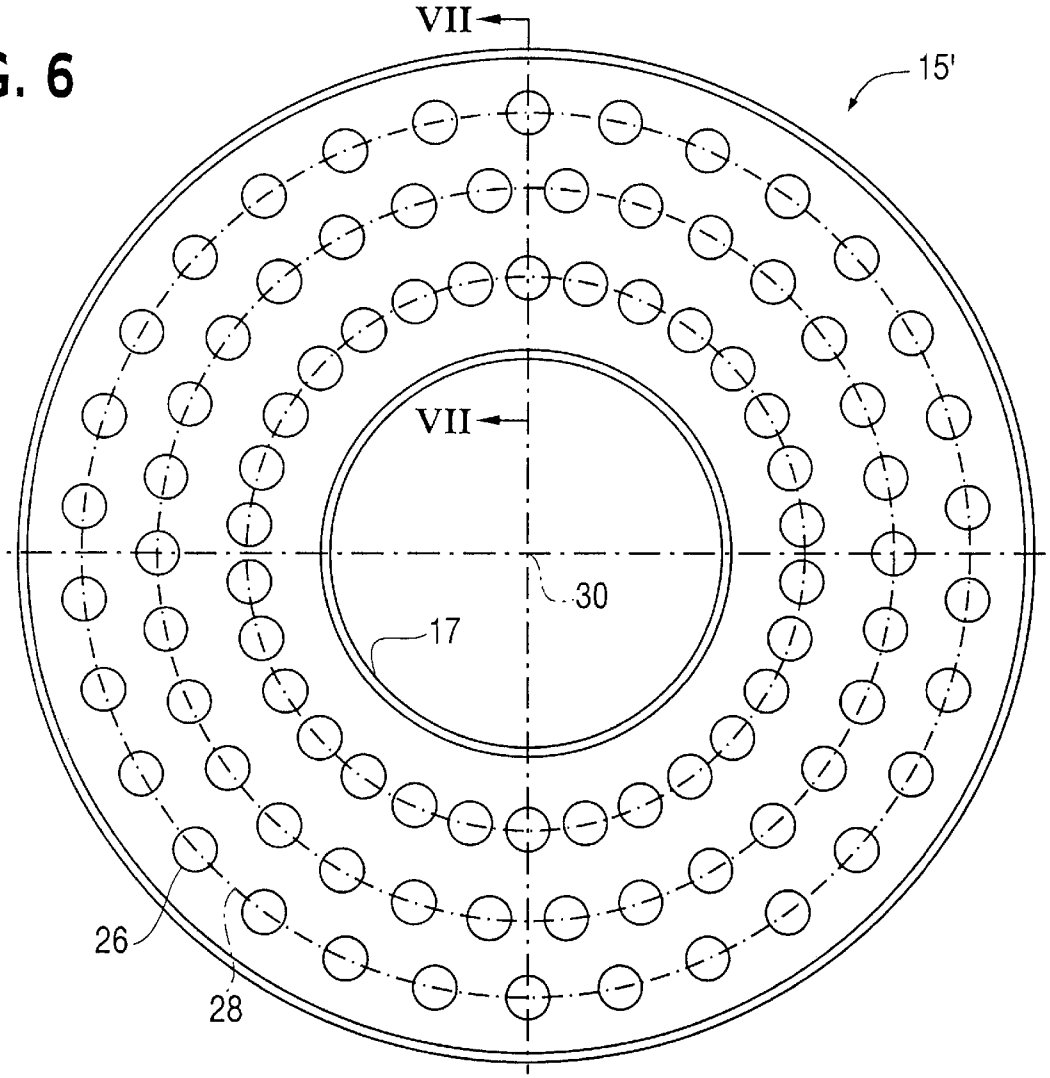
FIG. 6 shows a third embodiment of a drying element according to the invention.

The drying element 15' shown in the example in FIGS. 6–7 is of the same size, but use is made here of more, smaller tubular stays, i.e. 90 tubular stays distributed over three concentric circles 28, in that the tubular stays are 3' tubes.

According to the invention, it is thus possible, depending on the material to be treated in the drying plant, i.e. depending on the material's consistency, moistness, grain size etc., to optimally dimension the drying elements by the selection of the size and number of tubular stays, the configuration of the stays and their positioning, to provide a drying plant which has optimal energy efficiency, without detriment to the quality of the plant with regard to lifetime and operational reliability.

Figure 8:
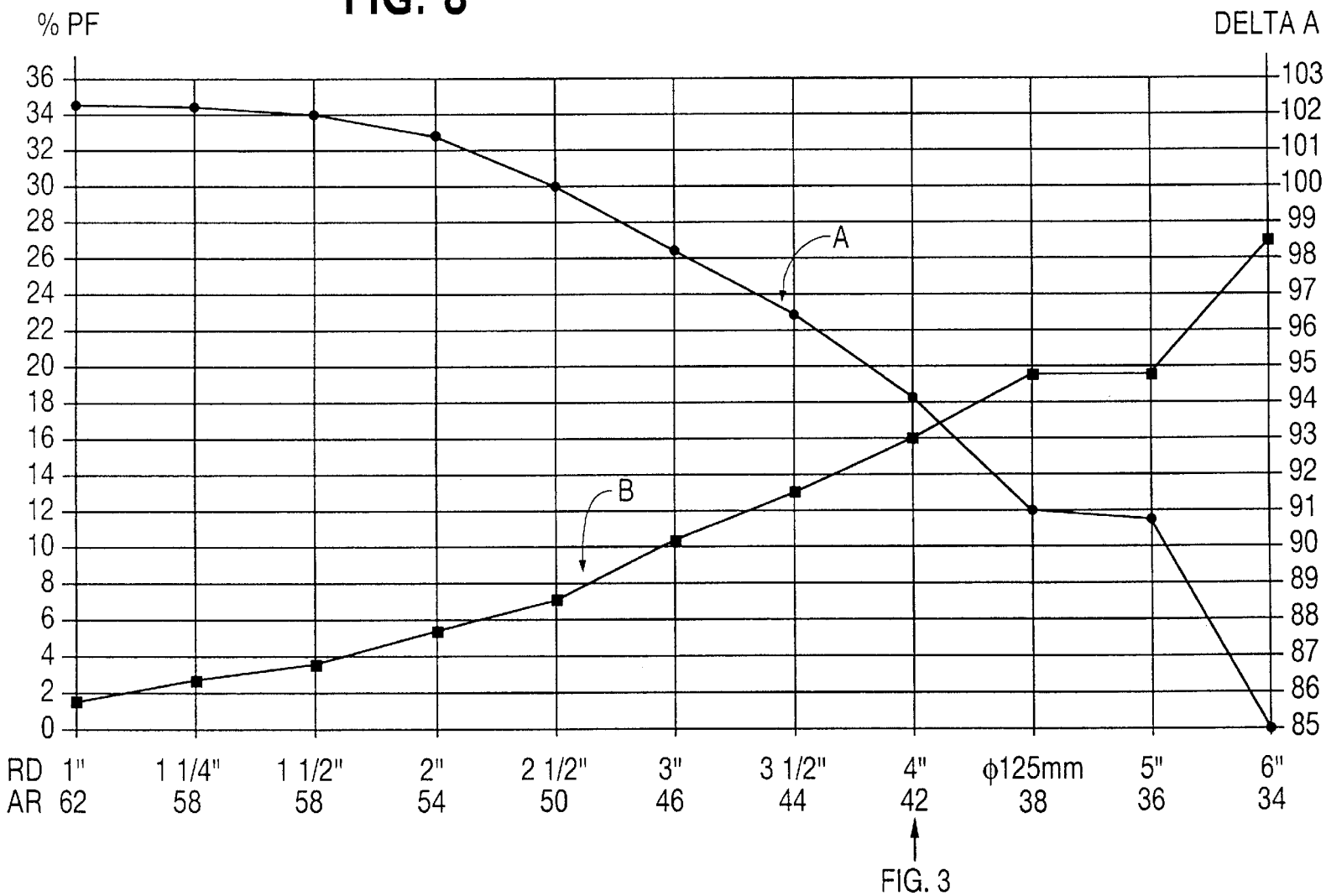
FIG. 8 shows a diagram of the flow and area relationship of different drying elements according to the invention.

FIG. 8 is a diagram showing two curves A and B for different embodiments of the drying elements according to the invention.

The curve A shows variations in the heat surface area delta A in percentage (the ordinate at the right-hand side) on a drying element according to the invention in relation to a drying element with the same diameter but without tubular stays.

The curve B shows variations in the area of passage PF (Plug Flow) in percentage (the left-hand ordinate axis) in a drying element according to the invention in relation to a drying element with the same diameter but without openings.

The curves A and B are calculated for relevant numbers of tubular stays (AR) and stay diameters (RD), which are marked on the horizontal axis.

AR thus indicates the number of tubular stays used, and RD indicates the inside diameter of the tubular stays used.

The tubular stays are evenly distributed over the area of the drying element as shown in the earlier examples.

It will be seen that if a large number of small tubular stays are used, a large heat surface (delta A>100%) is obtained, but with a low "plug flow". The example discussed earlier and as shown in FIG. 3 is also directly marked in the diagram. In this example, the "plug flow" obtained is thus 16% with a Delta A of approx. 94%. For a quite modest reduction in the heat surface, it is thus possible to achieve a considerable flow through the drying elements.

The diagram thus shows how it is possible to a great extent to dimension a drying element according to the invention so that it has the desired characteristics, especially with regard to energy efficiency, production capacity etc.

Figure 9:
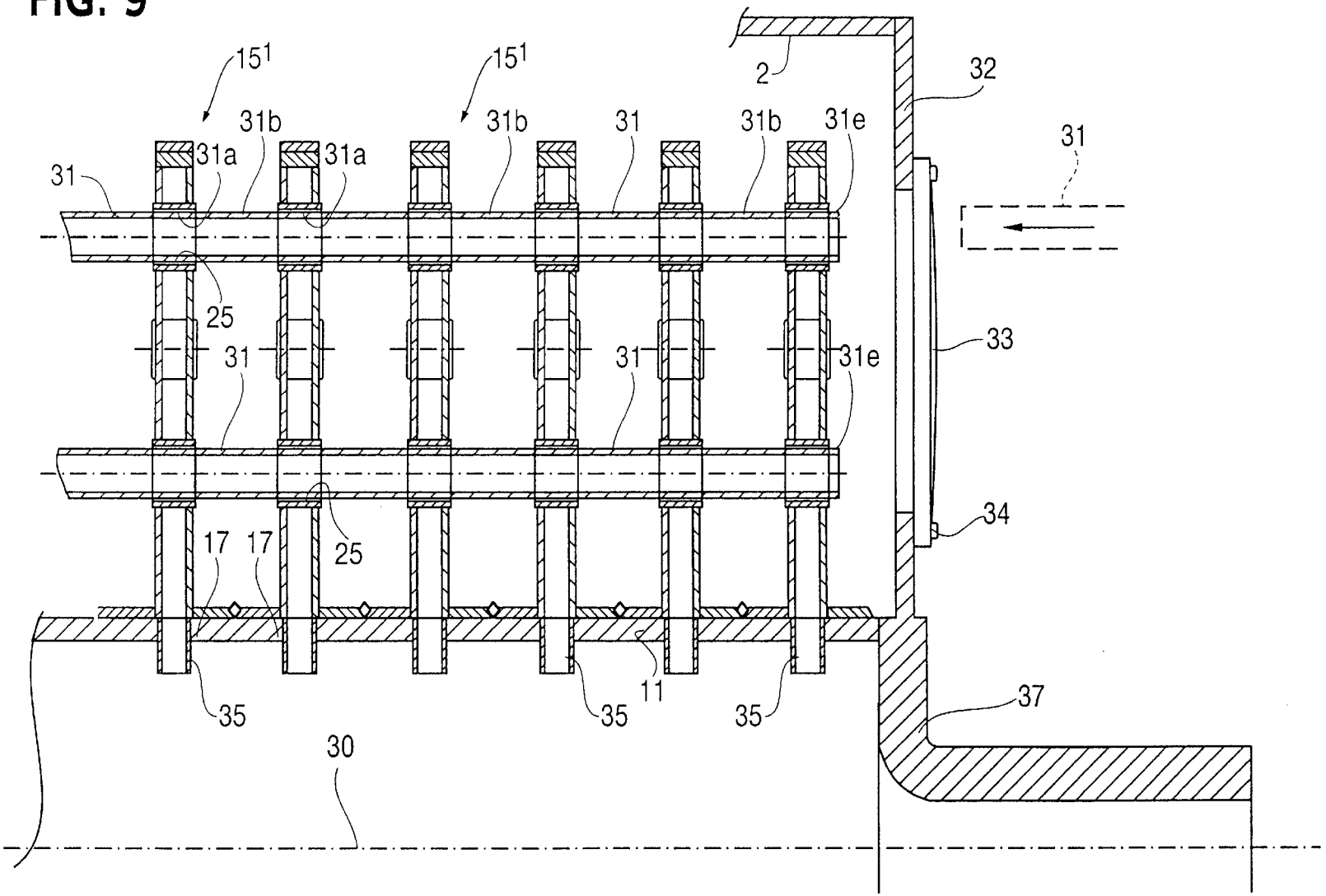
FIG. 9 shows an axial section in a part of a rotor in a fourth embodiment of the invention.
Figure 10:
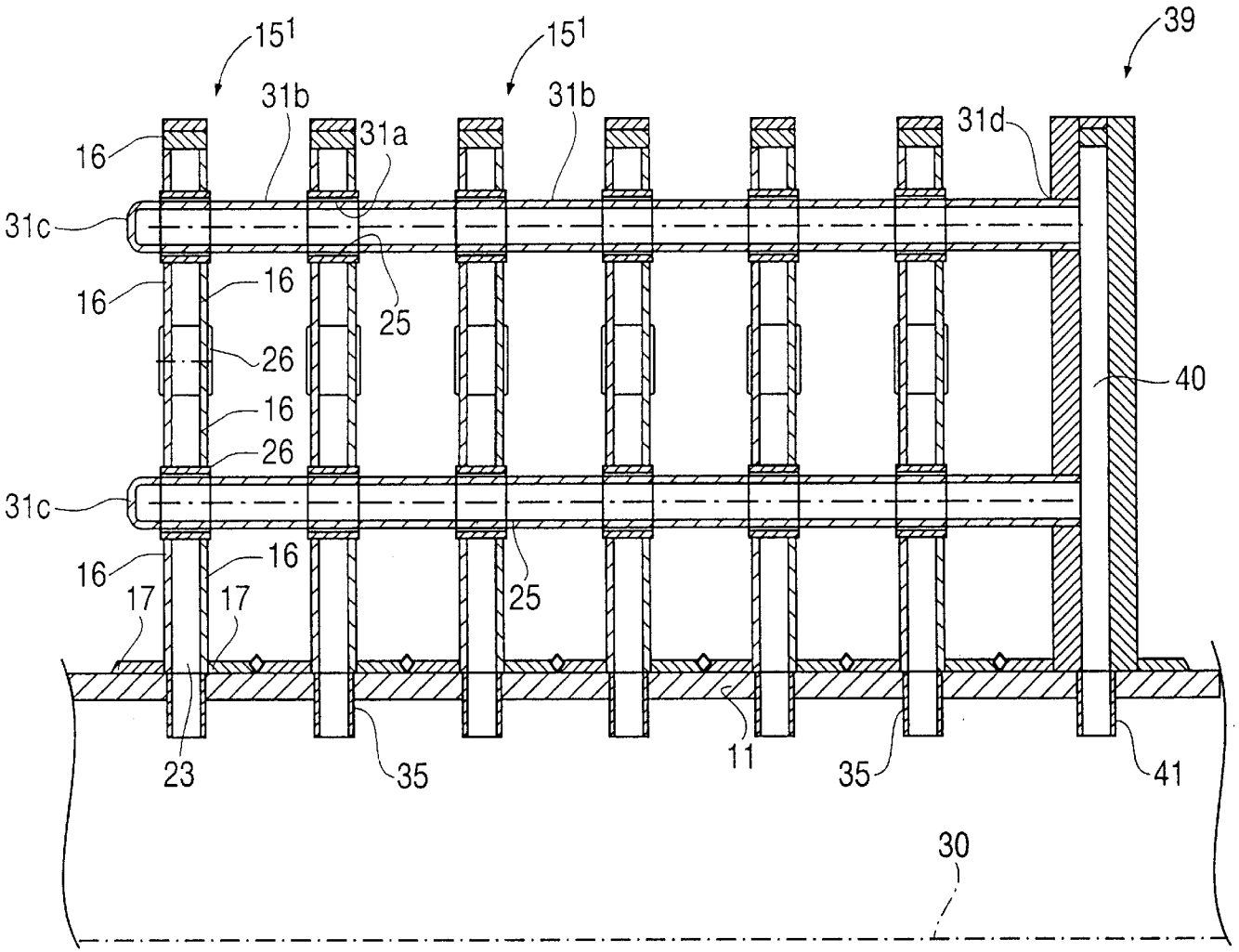
FIG. 10 shows an axial cross-section corresponding to FIG. 9 in a fifth embodiment of the invention.

In FIGS. 9 and 10 is seen an axial cross-section of a part of a rotor for a drying plant according to the invention.

The rotor's center axis 30 is shown, and above this is seen the rotor's central pipe 11 for the supply of steam for heating and for the removal of condensate, which is effected in a commonly-known manner and which therefore is not described in further detail.

A number of annular drying elements 15' of the type discussed earlier in connection with FIGS. 3–7 is built up of plate elements 16 and, via their foot-pieces 17, are annularly welded together around the central pipe 11. The drying elements can be supplied with steam for heating via the tubular stubs 35.

The central pipe 11 is shown closed at the one end with an axle journal closure 37 in a commonly-known manner, and sealed off from the end 32 of the housing 2. The drying plant is otherwise built up in a commonly-known manner and will therefore not be described in more detail.

As explained earlier, each of the annular drying elements 15' has a number of through-going openings 25 in the axial direction, which openings can be provided with tubular stays 26.

In the drying plant according to the invention, all of the annular drying elements 15' are welded together at the annular foot-pieces 17 in such a way that the through-going openings 25 lie axially in a line, so that oppositely-lying holes have the same center axis. It hereby becomes possible to mount axial, elongated elements 31 through the openings, e.g. in the form of hollow tubes as shown in FIGS. 9 and 10. The elements 31 have a length which at least extends over the space between two adjacent drying elements 15', preferably over at least three adjacent elements.

The elements 31 can be tubular as shown, and can be divided into holding parts 31*a* for engagement with the drying elements 15', and in lifting parts 31*b* which can be configured in any desired manner, so that they constitute a lifting element. The areas 31*b* can, for example, be polygonal or directly U-shaped, so that the product to be treated is lifted during the rotation.

The elements 31 are preferably secured to the first of the annular drying elements 15' by welding 31*e*. The elements 31 are preferably standard tubes with a diameter which substantially fills out the tubular stays 26.

A cover 33 can be provided in the end 32 of the housing, e.g. secured with bolts 34. When the cover is removed, drying elements 31 can be inserted in or removed from the rotor, in that by rotation of the rotor the openings in the drying elements 15' can be brought into the opening which lies under the cover. The insertion of an element 31 is shown by way of a sketch.

In the example shown in FIG. 9, elongated elements 31 are placed in some of the outermost openings 25 and in some of the innermost openings, but not in the intermediate openings. The number of elongated elements and where they are placed will depend on the degree to which the stirring is desired to be increased. In the examples shown in FIGS. 9 and 10, four elements 31 displaced 90° are inserted in the outermost openings 25, and four elements similarly displaced 90° are inserted in the innermost openings, i.e. eight elements in all. It will be obvious to those familiar with the art that the number of elements 31 and their positioning will depend on many different aspects, e.g. the type of product to be treated, how it is required to be treated and how the rotor is otherwise arranged and dimensioned etc.

FIG. 10 shows an embodiment of the invention where all of the elongated elements 31 are at the one end welded together with a manifold 39 by welds 31*d*, said manifold comprising a distribution chamber 40 and a supply pipe 41 for steam. The opposite ends of the elements 31 are closed by caps 31*c*. During the heating by the steam, condensate is formed which can be returned the same way as the steam is introduced, in that e.g. the whole of the drying plant can be inclined slightly towards the manifold 39, e.g. at an angle of a few degrees, so that the condensate can return of its own accord to the manifold 39.

The way shown in FIG. 10 of supplying heating or cooling medium to the elongated tube elements 31 is only an example of how this can be implemented.

What is claimed is:

1. An annular drying element for mounting on an axle of a rotor in a drying plant comprising:

at least one pair of annular plate elements, each pair of annular plate elements having as a part thereof a supply of a medium for heating or cooling and a drain for draining condensate therefrom; and through-going openings extending from one side of each of the at least one pair of annular plate elements to an opposed side thereof with at least some of the through-going openings passing material which is dried by the drying plant along the rotor during drying thereof past the at least one pair of annular plate elements.

2. An annular drying element according to claim 1, wherein:

a tube piece is inserted in each through-going opening.

3. An annular drying element according to claim 2, wherein:

the tube pieces are disposed longitudinally parallel to the rotor.

4. An annular drying element according to claim 1, wherein:

each pair of annular plate elements comprises two substantially identical annular plate elements spaced apart from each other.

5. An annular drying element according to claim 3, wherein:

the tube pieces are stays between annular plate elements which are configured with the through-going openings.

6. An annular drying element according to claim 5, wherein:

the tube pieces have a circular cross-sectional profile, and the through-going openings in which the tube pieces are mounted are circular.

7. An annular drying element according to claim 2, wherein:

the tube pieces are distributed over an annular surface area of the at least one pair of annular plate elements.

8. An annular drying element according to claim 5, wherein:

the tube pieces have a length corresponding to a thickness of at least one pair of annular plate elements.

9. An annular drying element according to claim 5, wherein:

the tube pieces have a length greater than a thickness of at least one pair of annular plate elements.

10. A drying element according to claim 9, wherein:

a free end of at least one of the tube pieces is cut off and has a mouth not disposed in a plane parallel with the at least one pair of annular plate elements.

11. An annular drying element according to claim 5, wherein:

the stays have different clearances.

12. An annular drying element according to claim 5, wherein:

the stays are distributed in circles concentric with an outer edge of the at least one pair of annular plate elements.

13. A drying plant for heating or cooling of moist, comminuted material of animal, vegetable or chemical origin comprising:

a stationary housing and a rotor comprising annular drying elements, each annular drying element comprising pairs of annular plate elements having as a part thereof a supply of a medium for heating or cooling and a drain which drains condensate therefrom; and wherein each pair of the annular plate elements has through-going openings extending from one side to an opposed side thereof with at least one elongated element inserted in at least one through-going opening which is longer than a distance between adjacent pairs of annular plate elements.

14. A drying plant according to claim 13, wherein:

at least one elongated element has a length extending along at least three adjacent pairs of annular plate elements.

15. A drying plant according to claim 14, wherein:

the at least one elongated element has a length extending along all annular plate elements.

16. A drying plant according to claim 13, wherein:

the at least one elongated element is a tube having a passage extending along a length thereof.

17. A drying plant according to claim 13, wherein:

the at least one elongated element is divided into areas which engage pairs of opposed annular plate elements, and an intermediate area positioned between pairs of annular plate elements which lift and or stir product being dried in the plant.

18. A drying plant according to claim 13, wherein:

each of the at least one elongated element is secured to opposed pairs of annular plate elements by welding.

19. A drying plant according to claim 13, wherein:

the at least one elongated element has a passage through which the medium for heating or cooling flows during drying of a product by the plant.

20. A drying plant according to claim 13, wherein:

the at least one elongated element is secured in a manifold having channels for distributing the medium for heating or cooling.

21. A drying plant according to claim 13, wherein:

the stationary housing has at least one end with a cover disposed axially opposite the through-going openings in the at least one pair of annular plate elements.

22. A drying plant for heating or cooling of moist, comminuted material of animal, vegetable or chemical origin comprising:

a stationary housing and a rotor comprising annular drying elements with each annular drying element comprising pairs of annular plate elements having as a part thereof a supply of a medium for heating or cooling and a drain which drains condensate therefrom; and wherein each pair of annular plate elements has through-going openings extending from one side to an opposed side thereof with at least some of the through-going openings passing material which is dried by the drying plant along the rotor past the at least one pair of annular plate elements.

23. An annular drying element for mounting on an axle of a rotor in a drying plant comprising:

at least one annular drying element, each annular drying element having as a part thereof a supply of a medium for heating or cooling and a drain for draining condensate therefrom; and through-going openings extending from one side of the at least one annular drying element to an opposed side thereof with at least some of the through-going openings passing material which is dried by the drying plant along the rotor past the at least one annular drying element.

* * * * *